US006607404B1

(12) United States Patent
Ito et al.

(10) Patent No.: US 6,607,404 B1
(45) Date of Patent: Aug. 19, 2003

(54) CARD CONNECTOR

(75) Inventors: Toshiyasu Ito, Chiba (JP); Takashi Torii, Osaka (JP)

(73) Assignees: Yamaichi Electronics Co., Ltd., Tokyo (JP); Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/703,669

(22) Filed: Nov. 2, 2000

(30) Foreign Application Priority Data

Nov. 5, 1999 (JP) ..... 11-316109

(51) Int. Cl.[7] ..... H01R 23/70
(52) U.S. Cl. ..... 439/630; 439/680
(58) Field of Search ..... 439/630, 633, 439/680, 681, 677, 674

(56) References Cited

U.S. PATENT DOCUMENTS

| | | | |
|---|---|---|---|
| 3,823,367 | A | 7/1974 | Kaye et al. |
| 3,932,016 | A | 1/1976 | Ammenheuser |
| 4,780,603 | A | 10/1988 | Hamada |
| 4,864,116 | A | 9/1989 | Banjo et al. |
| 5,036,430 | A | 7/1991 | Hills |
| 5,198,645 | A | 3/1993 | Martin et al. |
| 5,207,598 | A | 5/1993 | Yamada et al. |
| 5,320,552 | A | 6/1994 | Reichardt et al. |
| 5,374,198 | A | 12/1994 | Nagata |
| 5,518,986 | A | 5/1996 | Winston |
| 5,581,127 | A | 12/1996 | Shinohara |
| 5,668,365 | A | 9/1997 | Ito et al. |
| 5,718,609 | A | 2/1998 | Braun et al. ..... 439/630 |
| 5,872,353 | A | 2/1999 | Reichardt et al. |
| 6,068,500 | A | 5/2000 | Kantner |
| 6,089,919 | A | 7/2000 | Nishioka |
| 6,126,486 | A | 10/2000 | Chang |
| 6,129,571 | A | 10/2000 | Ikemoto |
| 6,213,785 | B1 | 4/2001 | Nishio et al. |
| 6,234,845 | B1 | 5/2001 | Hakozaki |

FOREIGN PATENT DOCUMENTS

| | | |
|---|---|---|
| EP | 0 284 431 A2 | 9/1988 |
| JP | 63-133473 | 6/1988 |
| JP | 1-168978 | 11/1989 |
| JP | 2-187887 | 7/1990 |

(List continued on next page.)

OTHER PUBLICATIONS

Official Action in Japanese Patent Application No. 11–316108 (and an English translation thereof).
U.S. patent application Ser. No. 09/703,682, Ito et al., filed Nov. 2, 2000.

(List continued on next page.)

*Primary Examiner*—Tho D. Ta
*Assistant Examiner*—Phuong-Chi Nguyen
(74) *Attorney, Agent, or Firm*—Finneganm Henderson, Farabow, Garrett & Dunner, L.L.P.

(57) ABSTRACT

In the connector body, which has side portions for guiding the side surfaces of the IC card, a bottom portion having a support surface to support a front surface or back surface of the inserted IC card and stepped portions to engage the raised surface portion formed on the back surface so that the raised surface portion can be moved in an IC card , insertion/retraction direction, and a top plate portion disposed opposite the bottom portion to prevent the inserted IC card from floating upward; a leaf spring is provided to urge the IC card upward at a predetermined position with respect to the card insertion direction. The top plate portion has a blocking portion which engages the raised surface portion of the IC card at a predetermined blocking position and is disposed in front, with respect to the IC card insertion direction, of the predetermined position where the IC card is urged by the leaf spring.

8 Claims, 20 Drawing Sheets

FOREIGN PATENT DOCUMENTS

| | | |
|---|---|---|
| JP | 05-502746 | 5/1993 |
| JP | 06-044052 | 2/1994 |
| JP | 06-162281 | 6/1994 |
| JP | 07153524 | 6/1995 |
| JP | 7-335321 | 12/1995 |
| JP | 8-315081 | 11/1996 |
| JP | 09007694 | 1/1997 |
| JP | 10091729 | 4/1998 |
| JP | 10-187896 | 7/1998 |
| JP | 10240871 | 9/1998 |
| JP | 11-053503 | 2/1999 |
| JP | 11-316110 | 11/1999 |
| JP | 2000-277200 | 6/2000 |
| JP | 2001-135385 | 5/2001 |

OTHER PUBLICATIONS

U.S. patent application Ser. No. 09/705,747, Ito et al., filed Nov. 6, 2000.

U.S. patent application Ser. No. 09/869,784, Ito et al., filed Jul. 5, 2001.

U.S. patent application Ser. No. 09/890,637, Abe et al., filed Oct. 12, 2001.

International Search Report Application No. PCT/JP00/07762, dated Feb. 6, 2001 from the European Patent Office.

CARD CONNECTOR

This application is based on patent application Ser. No. 11-316109 filed Nov. 5, 1999 in Japan, the content of which is incorporated hereinto by reference.

BACKGROUND OF THE INVENTION

1. Field of the Invention

The present invention relates to a card connector for receiving an IC card such as memory card and more specifically to a card connector with an erroneous insertion prevention mechanism which, when the IC card is inserted in an inappropriate state, for example upside down, prevents the IC card from being inserted into a properly inserted position or connected position.

2. Description of the Related Art

Today the memory capacity is rapidly growing thanks to the remarkable advance of electronic circuit integration technology and there is a growing trend for using thin, small IC cards in the recording of various information such as characters, video and audio. Under this circumstance a variety of connectors for connecting the IC cards and electronic devices are being proposed and implemented.

FIG. 15A and FIG. 15B show one example of currently proposed IC card 1. As shown in the FIG., the IC card 1 has a card body 2 incorporating an IC in an almost rectangular case and a plurality of contacts 3 connecting to the IC in the card body 2 and leading out from the card body 2 to an external front end of the body 2. The card body 2 has a raised surface portion 4*a* protruding outwardly on its back surface 4 and also a notched portion 5 at one corner.

The raised surface portion 4*a* is rectangular in shape with its width between the outer side surfaces set smaller than a width between outer side surfaces of the card body 2. On the back surface 4 side, steps are formed between the raised surface portion 4*a* and other surfaces, i.e., recessed surface portions 4*b*. The raised surface portion 4*a* shown here includes outer end faces 6*a* of a plurality of separation walls 6 formed in the front portion of the back surface 4 of the card body 2 to separate contacts 3 from one another. The contacts 3 are securely attached with the recessed surface portions 4*b* between the separation walls 6.

The notched portion 5 is formed by cutting one corner of the front part of the card body 2 at angle, which makes the front part of the card body 2 asymmetric with respect to the direction of card insertion (X direction).

FIG. 16 shows a card connector 10 for holding the IC card. The card connector 10 has a connector body 11 for holding the IC card 1 so that it can be inserted and retracted, and also electric contacts 12 for making electric contact with the IC card 1 inserted into the connector body.

The connector body 11 has side portions 13, a bottom portion 14, and a top plate portion 15. The side portions 13 have guide surfaces 13*a* for guiding side surfaces of The bottom portion 14 has support surfaces 14*a* for supporting the back surface 4 of front surface 7 of the IC card 1 and stepped portions 14*b* that engage the raised surface portion of the IC card so that the raised surface portion 4*a* can be moved in the direction of IC card insertion and retraction. The top plate portion 15 keeps the IC card 1 from floating up. The electric contacts 12 are disposed to correspond to the contacts 3 of the IC card 1 and held on the bottom portion 14 like cantilevered springs.

The connector body 11 is placed at a predetermined position on a printed circuit board of an electronic device, with the lower end portions of the electric contacts 12 soldered to predetermined conductive portions of the printed circuit board.

When the IC card 1 is to be connected to the card connector 10 of the above construction, it is inserted into the insertion direction (X direction) with the front surface 7 facing up, the back surface 4 supported on the support surfaces 14*a* and both of the outer side surfaces of the IC card 1 guided by both of the guide surfaces 13*a* of the connector body 11. At this time, the raised surface portion 4*a* formed on the back surface 4 of the IC card 1 engages the stepped portions 14*b* of the bottom portion 14 of the connector body 11 as the IC card 1 is inserted.

Then, when the front end portion of the IC card 1 engages an abutment portion 16 of the connector body 11 (see FIG. 19), the contacts 3 contact the electric contacts 12, thus completing the connection (see FIG. 17). In this insertion operation, the IC card 1 is prevented from floating upward and getting dislocated by the under surface of the top plate portion, so anyone can perform an insertion and connection operation easily and correctly.

In the connector shown in FIG. 16, as long as the IC card 1 is oriented correctly while being inserted, the connection to the card connector 10 can easily and reliably performed. When the IC card 1 is wrongly oriented and inserted, the card connector may be damaged. This is the problem with the conventional card connector that degrades the operability.

For example, when the IC card 1 is inserted upside down, as shown in FIG. 18, the raised surface portion 4*a* formed at the bottom of the IC card 1 and protruding upward abuts back surface 4, the rear end of the top plate portion 15, as shown in FIG. 19. This state, however, is not a completely inserted state and there is a chance of the user further pushing the card with force.

In this case, because the raised surface portion 4*a* projects slightly above the under surface of the top plate portion 15 as shown in FIG. 19, the IC card 1, when applied with a strong push, is forcibly inserted between the bottom portion 14 and the top plate portion 15 of the connector body 11, as shown in FIG. 20, deforming the top plate portion 15.

In the event of such a trouble, the side portions 13 of the IC card 1 are also deformed along with the top plate portion 15, exerting a load on soldered fittings on the side portions 13 of the connector body 11 used to secure the connector to the printed circuit board and also on soldered portions of the contacts, which in turn causes the soldered portions to come off, degrading the connection reliability of the connector.

The present invention has been accomplished to overcome the aforementioned problems with the conventional card connector and provides a highly reliable card connector capable of preventing the IC card from being inserted in an improperly oriented condition and thereby forestalling damages due to inappropriate insertion of the IC card.

SUMMARY OF THE INVENTION

To solve the above problems the present invention has the following construction. That is, this invention is characterized by a card connector having a connector body for removably holding an inserted IC card formed with a raised surface portion on a back surface side and electric contacts for making electrical contact with the IC card inserted in the connector body, the connector body comprising: side portions having card side surface guiding surfaces to guide side surfaces of the inserted IC card; a bottom portion having a support surface to support a front surface or back surface of the inserted IC card and stepped portions to engage the raised surface portion formed on the back surface so that the raised surface portion can be moved in an IC card insertion/retraction direction when the back surface of the IC card is supported on the support surface; a top plate portion disposed opposite the bottom portion to prevent the inserted IC card from floating upward; and an urging means provided in the connector body to urge the IC card upward at a predetermined position with respect to the card insertion direction; wherein the top plate portion having: a under surface side guiding surface disposed opposite the front surface of the IC card to guide the front surface; and a blocking portion to, when the front surface of the IC card is supported on the support surface, engage the raised surface portion of the IC card at a predetermined blocking position to prevent the IC card from being moved forward from the blocking position, the blocking portion being disposed in front, with respect to the IC card insertion direction, of the predetermined position where the IC card is urged by the urging means.

The above and other objects, features and advantages of the present invention will become more apparent from the following description of embodiments thereof taken in conjunction with the accompanying drawings.

DETAILED DESCRIPTION OF THE PREFERRED EMBODIMENTS

Figure 1:
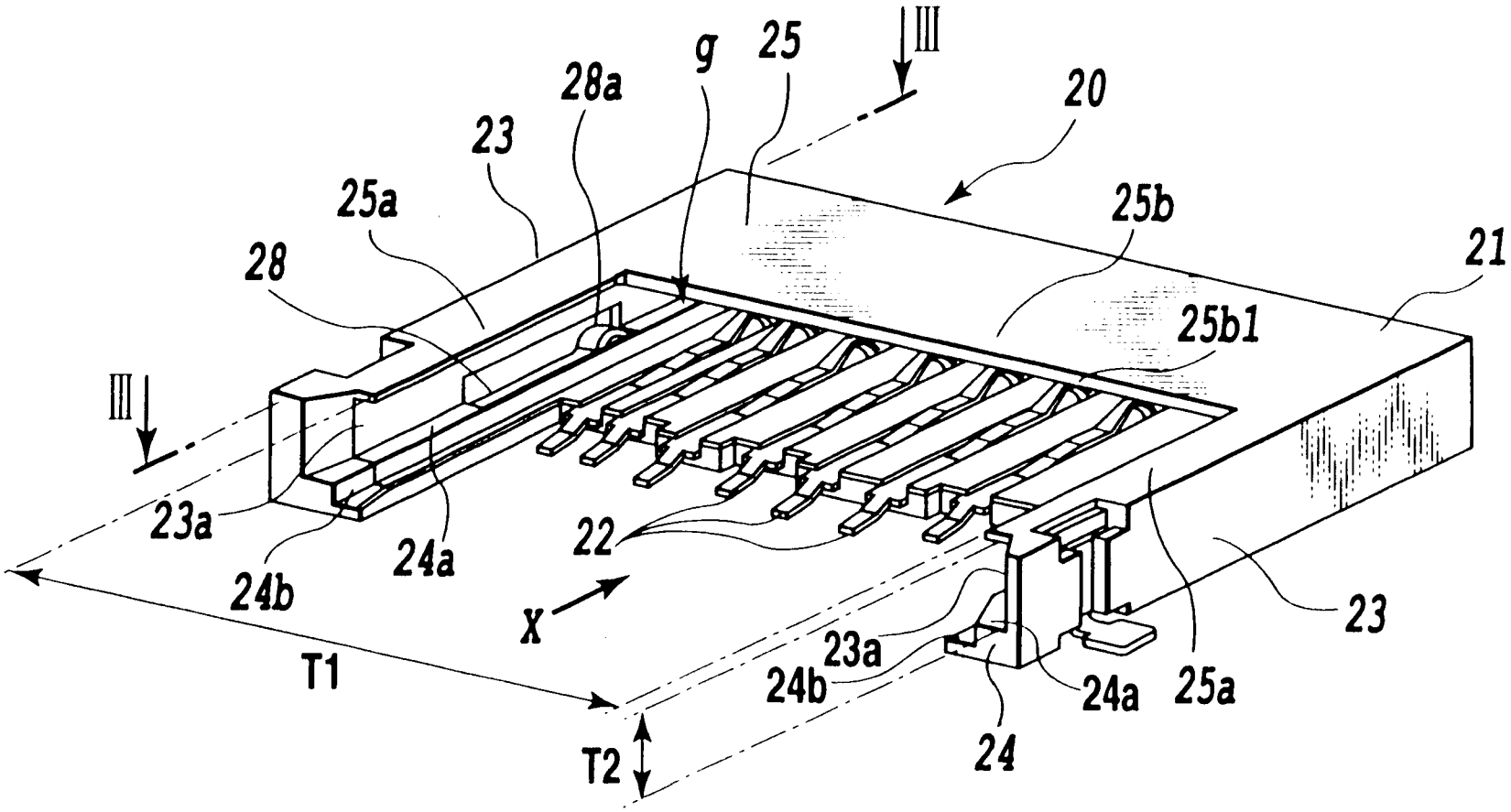
FIG. 1 is an external perspective view of a card connector according to a first embodiment of the invention.

Now, embodiments of the present invention will be described by referring the accompanying drawings.

First Embodiment

FIG. 1 to FIG. 9 show a card connector according to the first embodiment of the invention. Throughout these drawings elements identical to those of the conventional art described above are given like reference numerals.

Figure 15A:
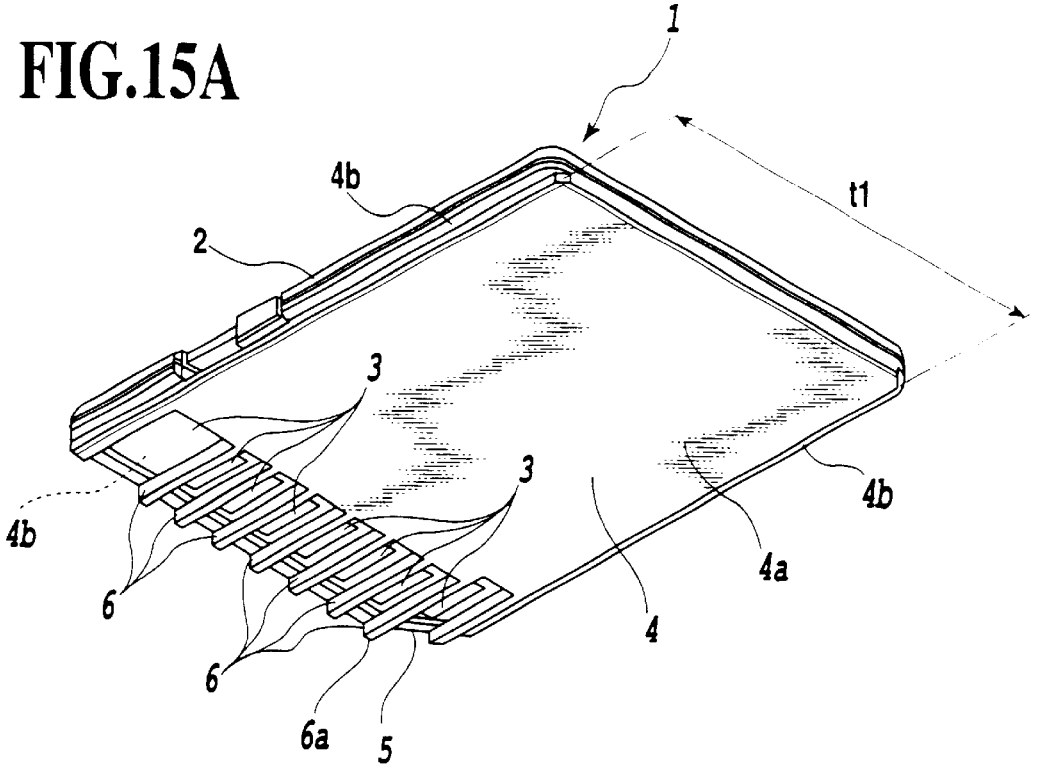
FIG. 15A is a perspective view of an IC card connector as seen from the back side.
Figure 15B:
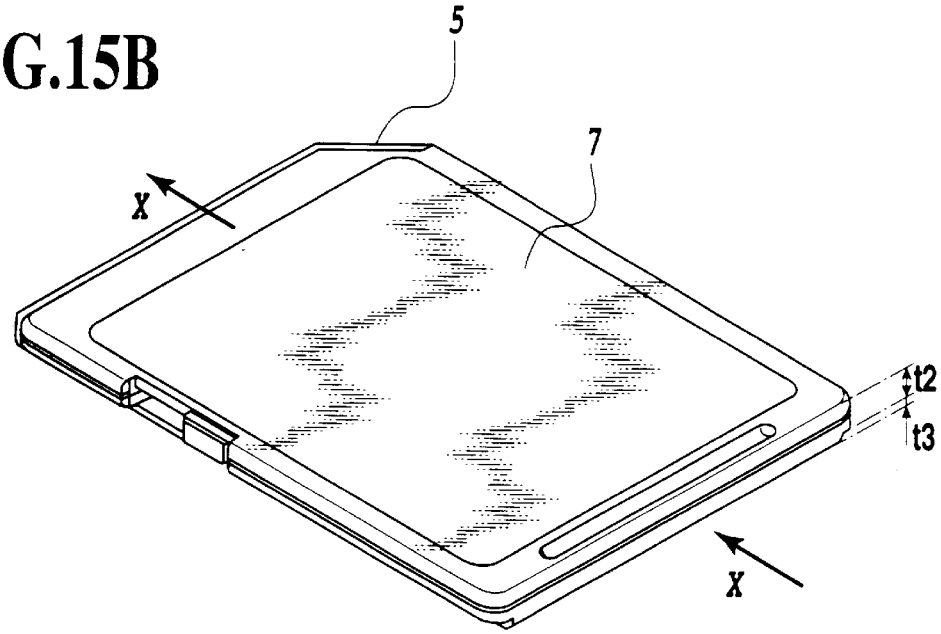
FIG. 15B is a perspective view of the IC card connector as seen from the front side.
Figure 16:
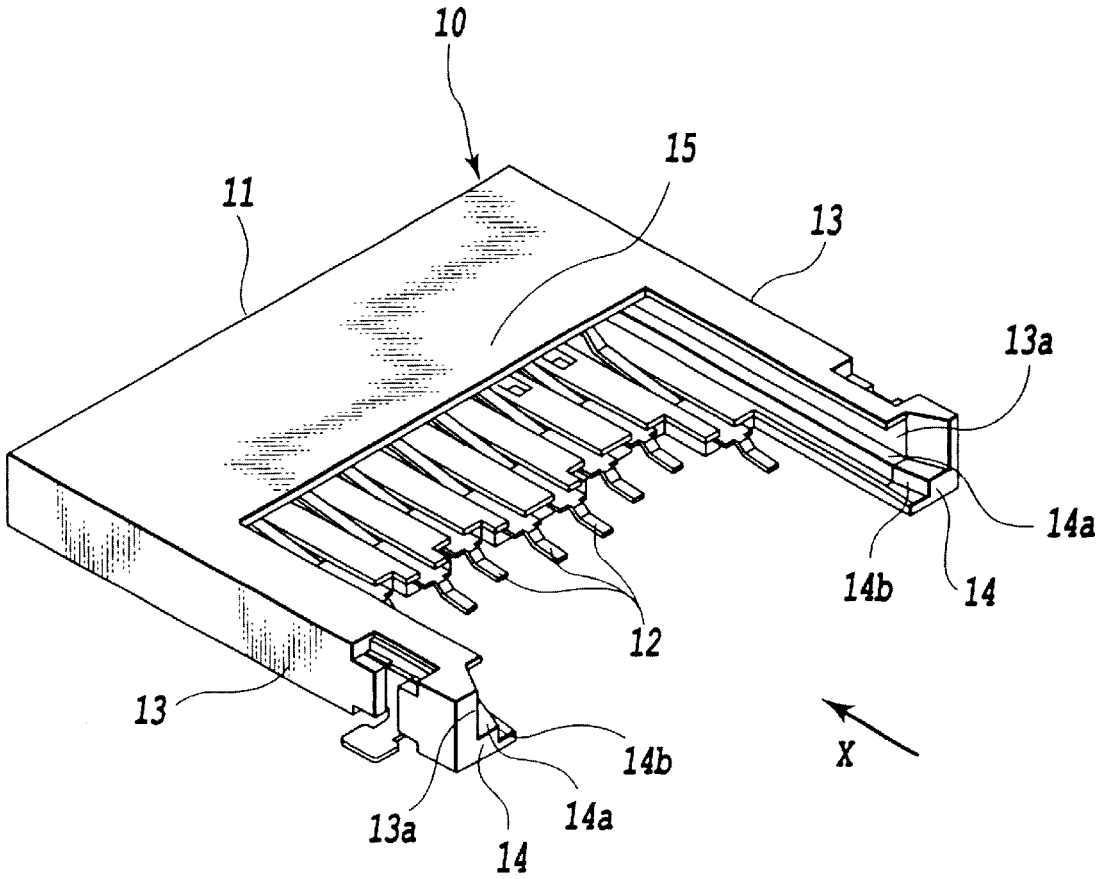
FIG.16 PRIOR ART
FIG. 16 is a perspective view of a card connector according to a prior art of the invention.
Figure 17:
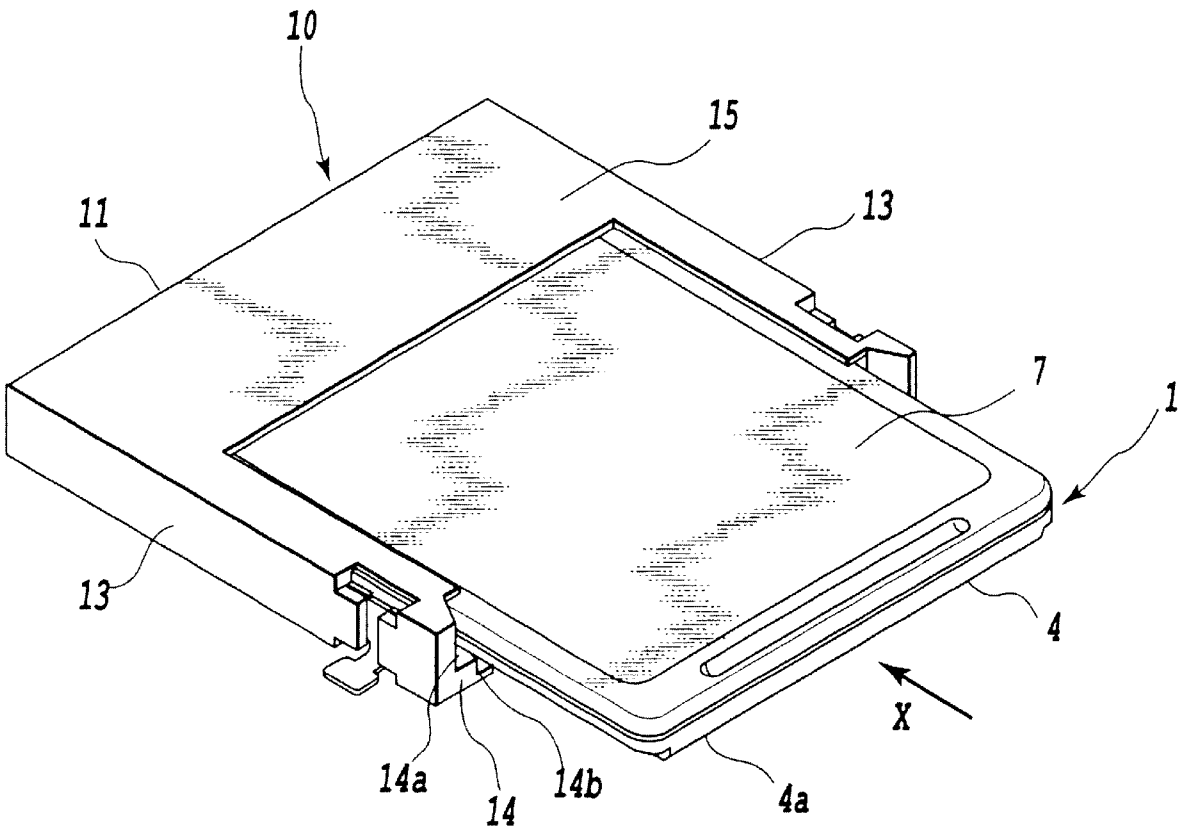
FIG.17 PRIOR ART
FIG. 17 is a perspective view showing the IC card inserted in an appropriate state into the card connector of FIG. 16.
Figure 18:
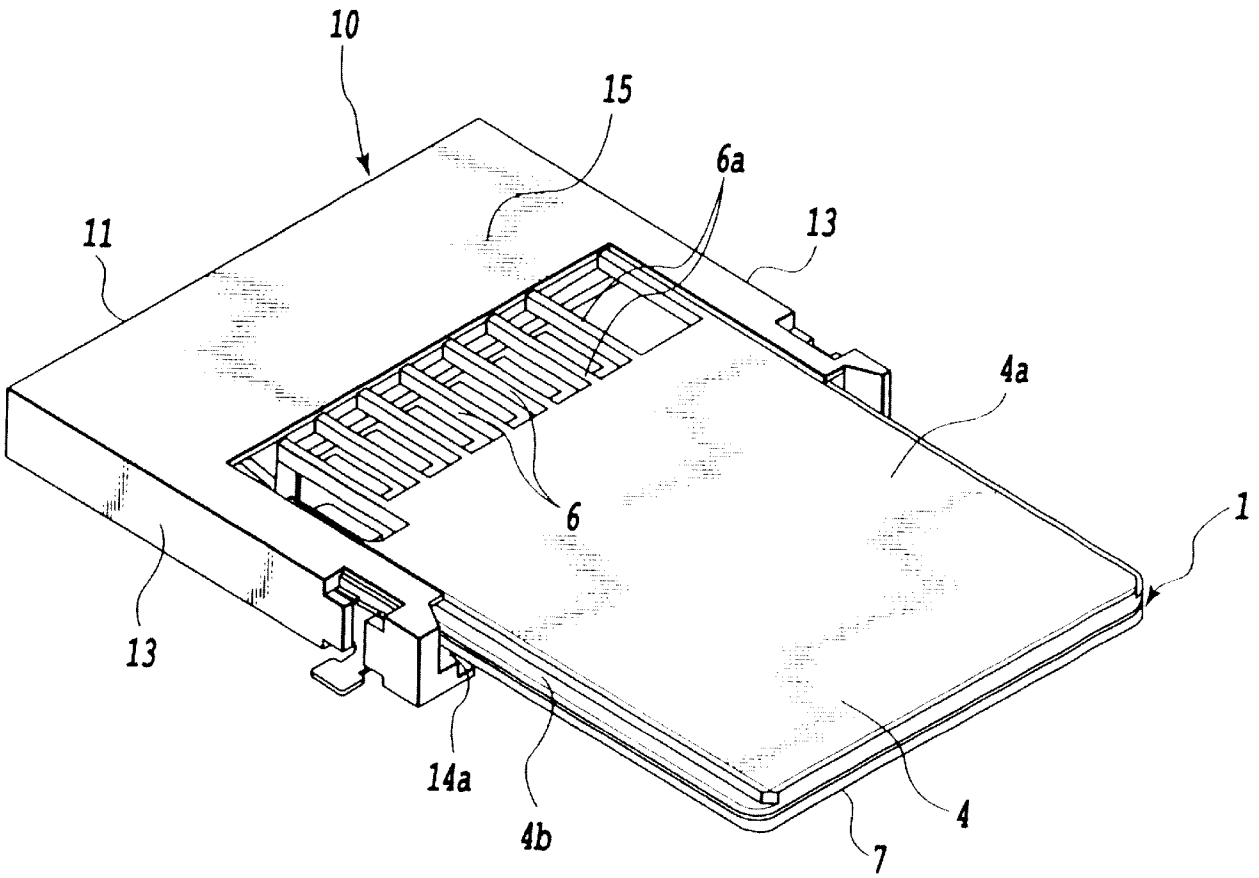
FIG.18 PRIOR ART
FIG. 18 is a perspective view showing the IC card inserted in an inappropriate state into the card connector of FIG. 16.
Figure 19:
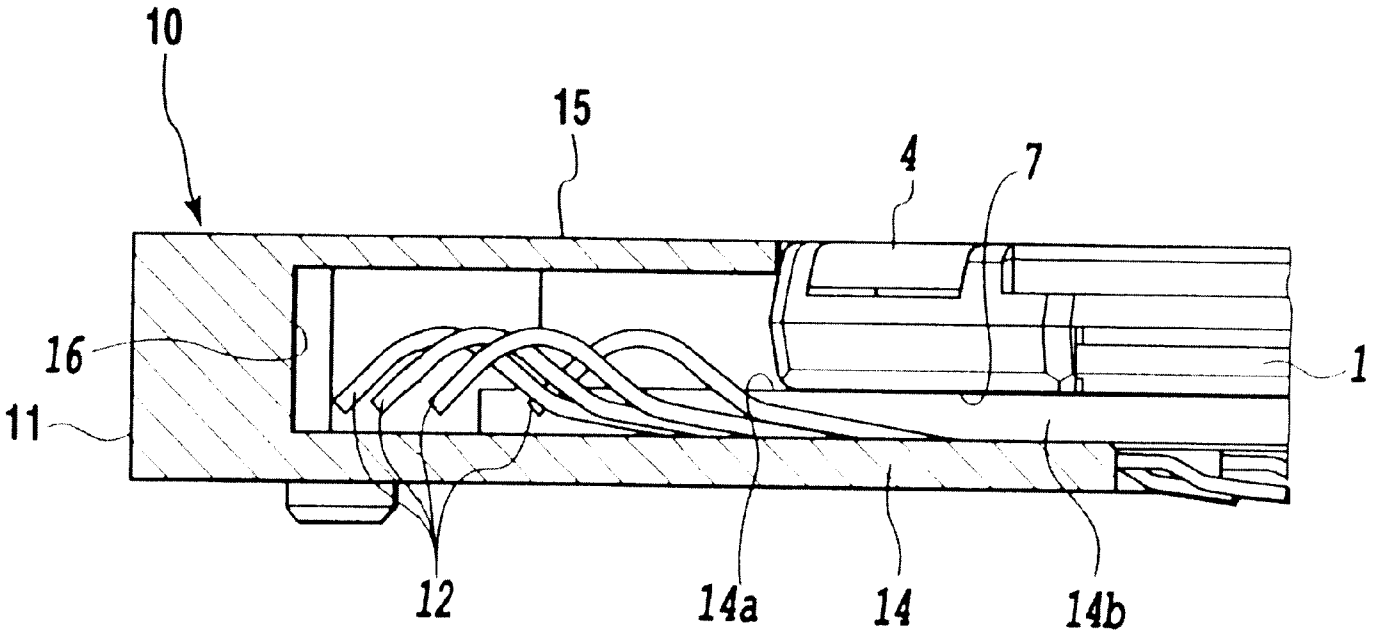
FIG.19 PRIOR ART
FIG. 19 is a vertical cross-sectional side view showing the IC card inserted in an inappropriate state into the card connector of FIG. 16 with raised surface portion of the IC card abutting against a top plate portion.
Figure 20:
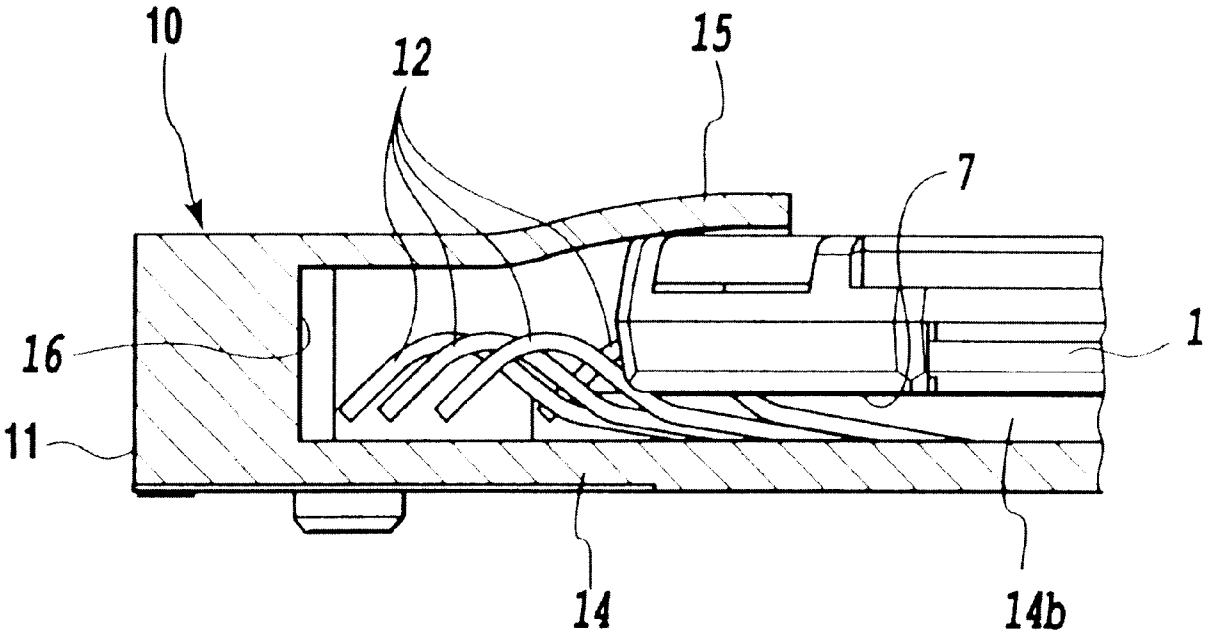
FIG.20 PRIOR ART
FIG. 20 is a vertical cross-sectional side view showing the IC card further inserted from the state of FIG. 19.

An IC card 1 applied to the connector of the first embodiment is identical to the one shown in FIGS. 15A and 15B and its explanation is omitted here.

A connector 20 in the first embodiment comprises a connector body 21 which holds the IC card 1 so that it can be inserted into and retracted from the connector body, and electric contacts 22 that make electrical contact with the IC card 1 inserted into the connector body 21. The connector body 21 has side portions 23, a bottom portion 24, a top plate portion 25, and an abutment portion 26. The side portions 23 have guide surfaces 23*a* for guiding left and right outer side surfaces of the IC card 1. The bottom portion 24 has support surfaces 24*a* that support a recessed surface portion 4*b* of a back surface 4 or front surface 7 of the IC card 1 and stepped portions 24*b* that, when they support the back surface of the IC card 1, engage a raised surface portion 4*a* formed on the back surface 4 so that the raised surface portion 4*a* can be moved in the direction of IC card insertion and retraction. The top plate portion 25 is disposed opposite the bottom portion 24 to guide and prevent the IC card I from floating upward as it is inserted. The abutment portion 26 abuts against a front end of the IC card 1 to lock it at the properly inserted position or connected position when it is inserted in an appropriate state. The side portions 23, bottom portion 24, electric contacts 22 and abutment portion 26 are similar in construction to those shown in FIGS. 16 to 20.

The top plate portion 25 disposed opposite the bottom portion 24 of the connector body 21 protrudes like eaves and has integrally formed therewith a pair of left and right side restriction portions 25*a* protruding inwardly from the upper ends of the left and right side portions 23 beyond the guide surfaces 23*a* and a front restriction portion 25*b* protruding inwardly from the upper end of the abutment portion 26. The top plate portion 25 therefore is U-shaped as a whole when viewed from above.

The top plate portion 25 is formed with a rectangular engagement groove g which is enclosed on three sides by the edge of the top plate portion with one side cut away. A lateral width T1 of the engagement groove g (i.e., the width in a direction perpendicular to the IC card insertion direction) is set slightly larger than a lateral width t1 of a raised surface portion 4*a* of the IC card 1. A distance T2 from the underside of the top plate portion 25 of the connector 20 to the support surfaces 24*a* of the bottom portion 24 is set slightly larger than a distance (thickness) t2 from a recessed surface portion 4*b* of the IC card 1 to the front surface 7.

Figure 7:
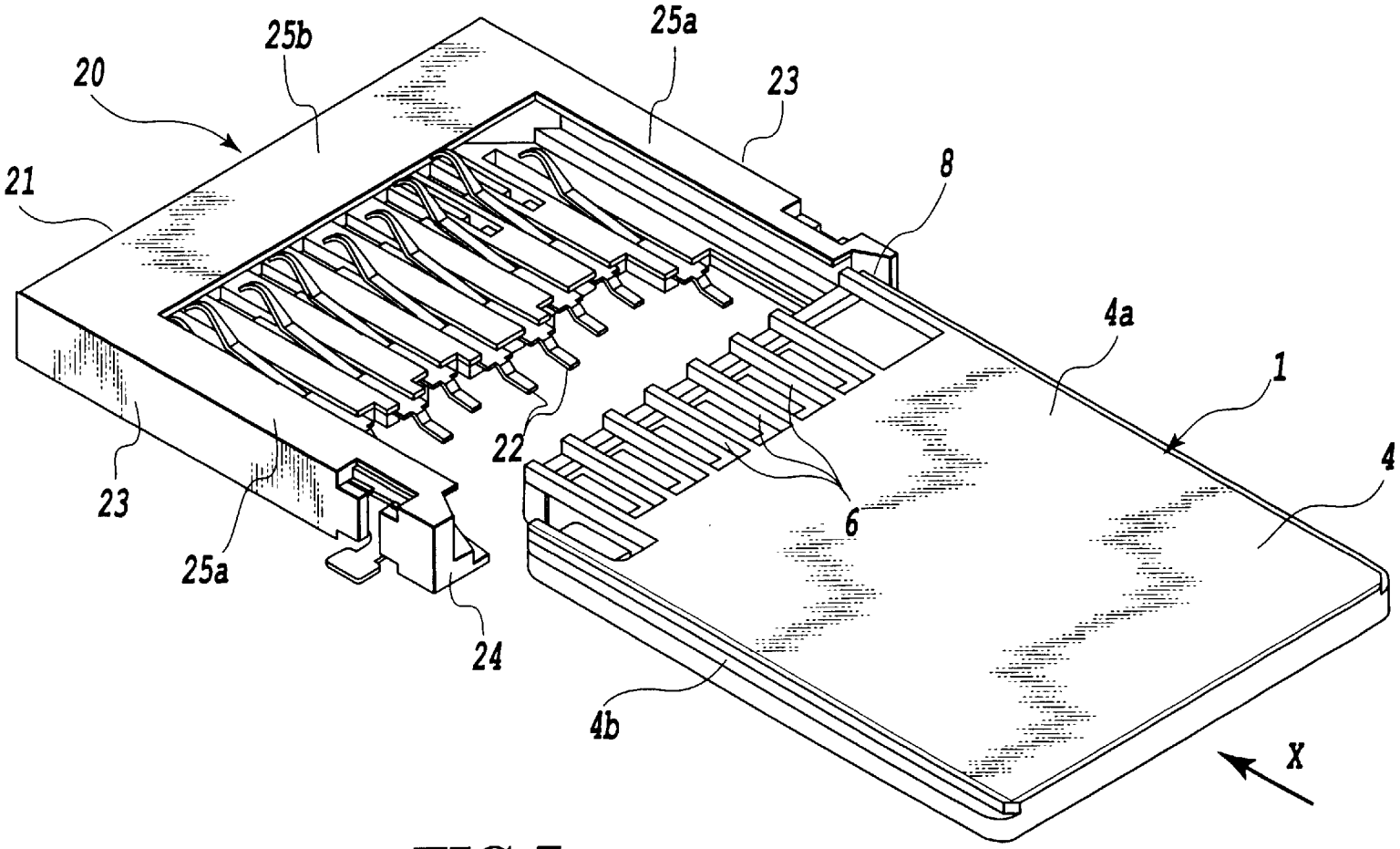
FIG. 7 is a perspective view showing the IC card being inserted in an improper state into the card connector of FIG. 1.

The connector body 21 has an erroneous insertion prevention structure which prevents the IC card 1 from being inserted to the connected position when the IC card 1 is inserted in an improper condition as shown in FIG. 7, i.e., with the front surface 7 of the IC card 1 supported on the support surfaces 24*a* of the bottom portion 24.

Figure 2:
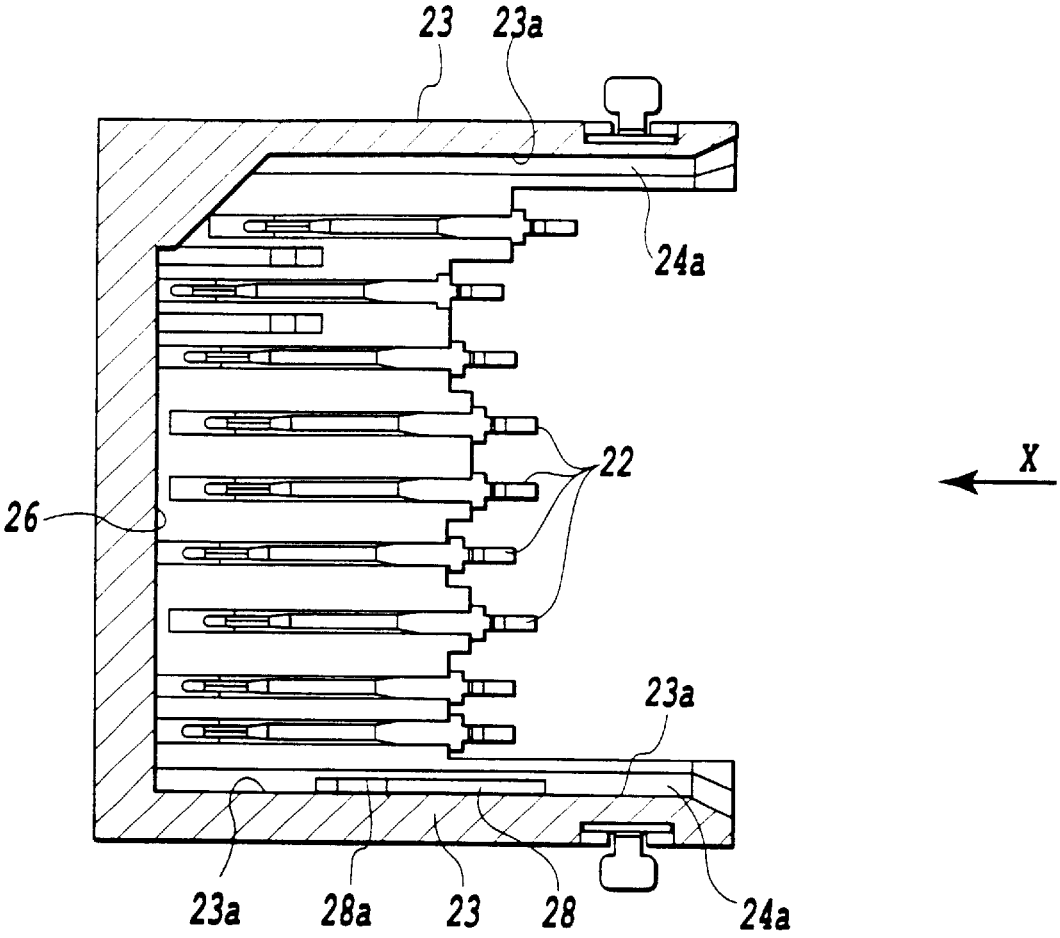
FIG. 2 is a horizontal cross section showing a bottom portion of the first embodiment of the invention.
Figure 3:
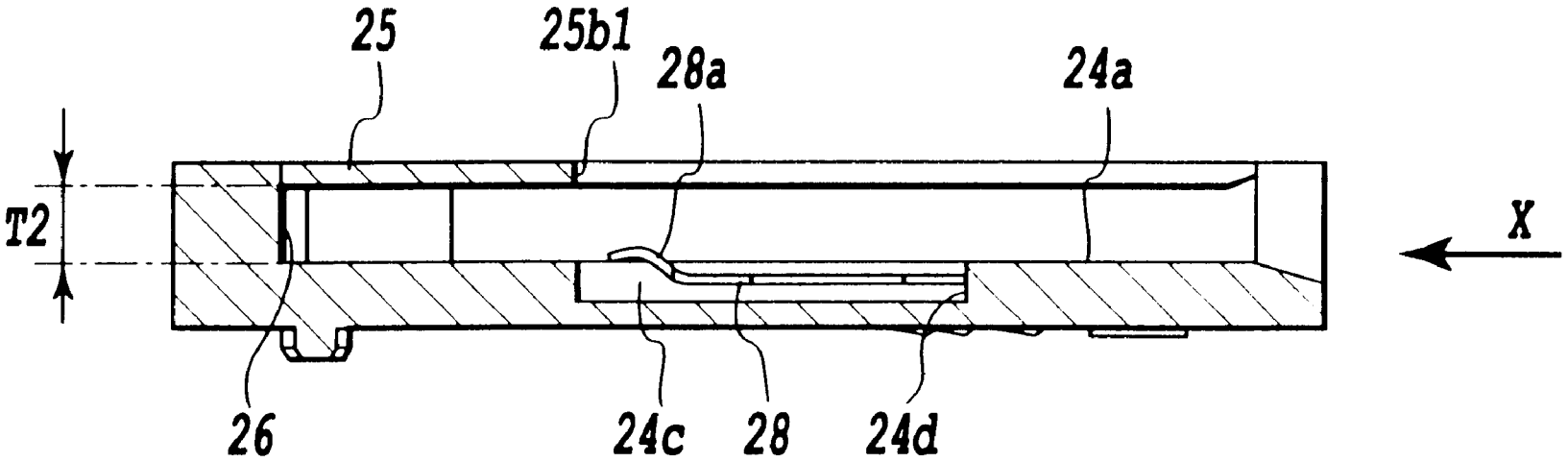
FIG. 3 is a cross section taken along the line A—A of FIG. 1.
Figure 4:
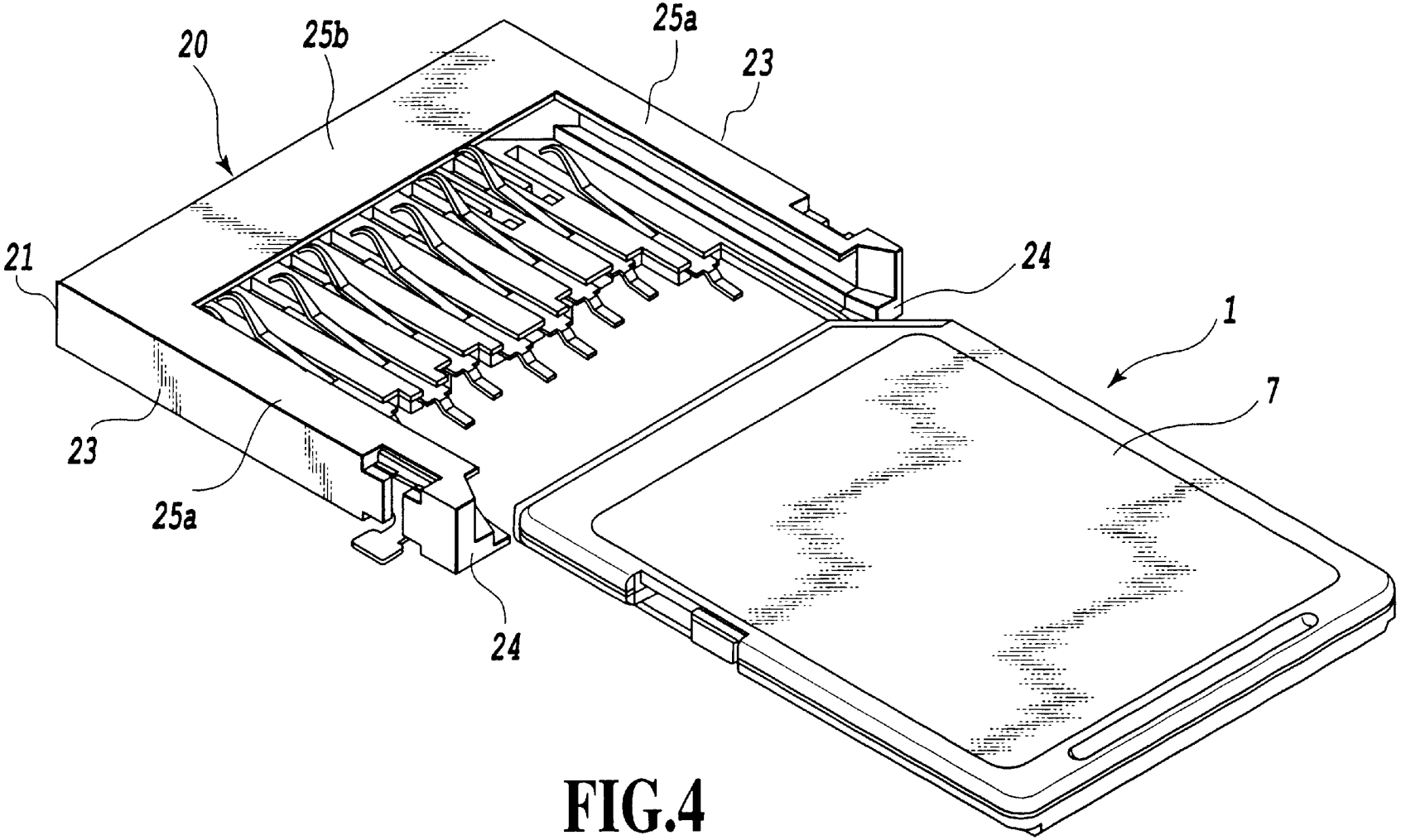
FIG. 4 is a perspective view showing an IC card being inserted in an appropriate state into the card connector of FIG. 1.

The erroneous insertion prevention structure, as shown in FIGS. 1 to 3, comprises a leaf spring (urging means) 28 made of an elastic member secured to the support surface 24*a* of the connector body 21 and the front restriction portion 25*b*. The leaf spring 28 is held almost horizontally, like a cantilever, to a rear side wall 24*d* of an accommodation groove 24*c* formed in the bottom portion 24 on one side. The leaf spring 28 has at its free end a press portion 28*a* curved toward the top plate portion to project upward from the support surface 24*a* of the bottom portion 24.

The leaf spring 28, except for its press portion 28*a*, is accommodated in the accommodation groove 24*c*, with only the press portion 28*a* projecting upwardly from the support surface 24*a*. The press portion 28*a* is situated behind the front restriction portion 25*b* when viewed in the insertion direction (X direction).

A rear end portion (lock portion) 25*b*1 of the front restriction portion 25*b* is situated in front of the press portion 28*a* of the leaf spring 28 with respect to the IC card insertion direction.

Figure 5:
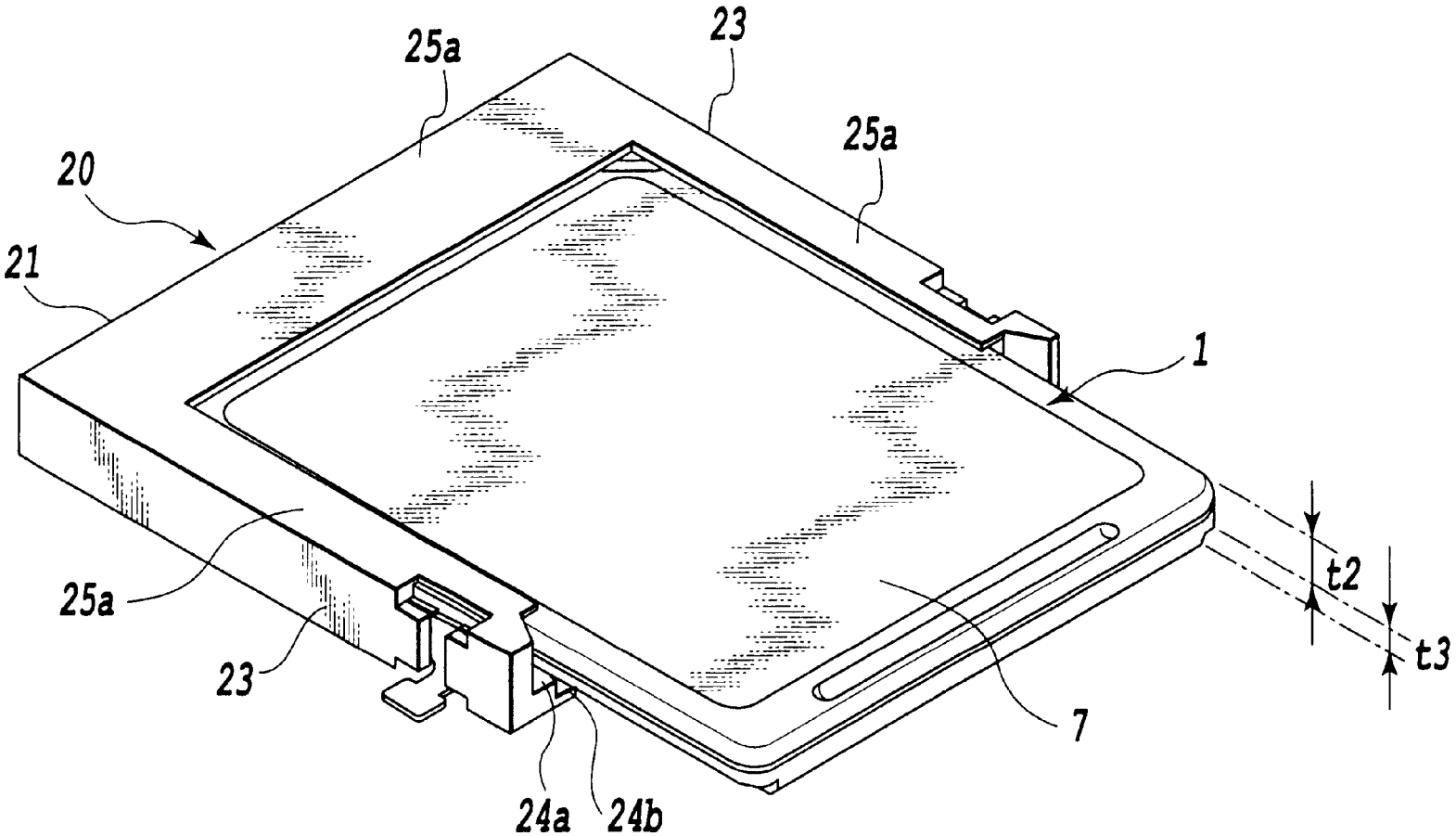
FIG. 5 is a perspective view showing the IC card inserted from the state of FIG. 4 to a properly inserted position or connected position in the card connector.
Figure 6:
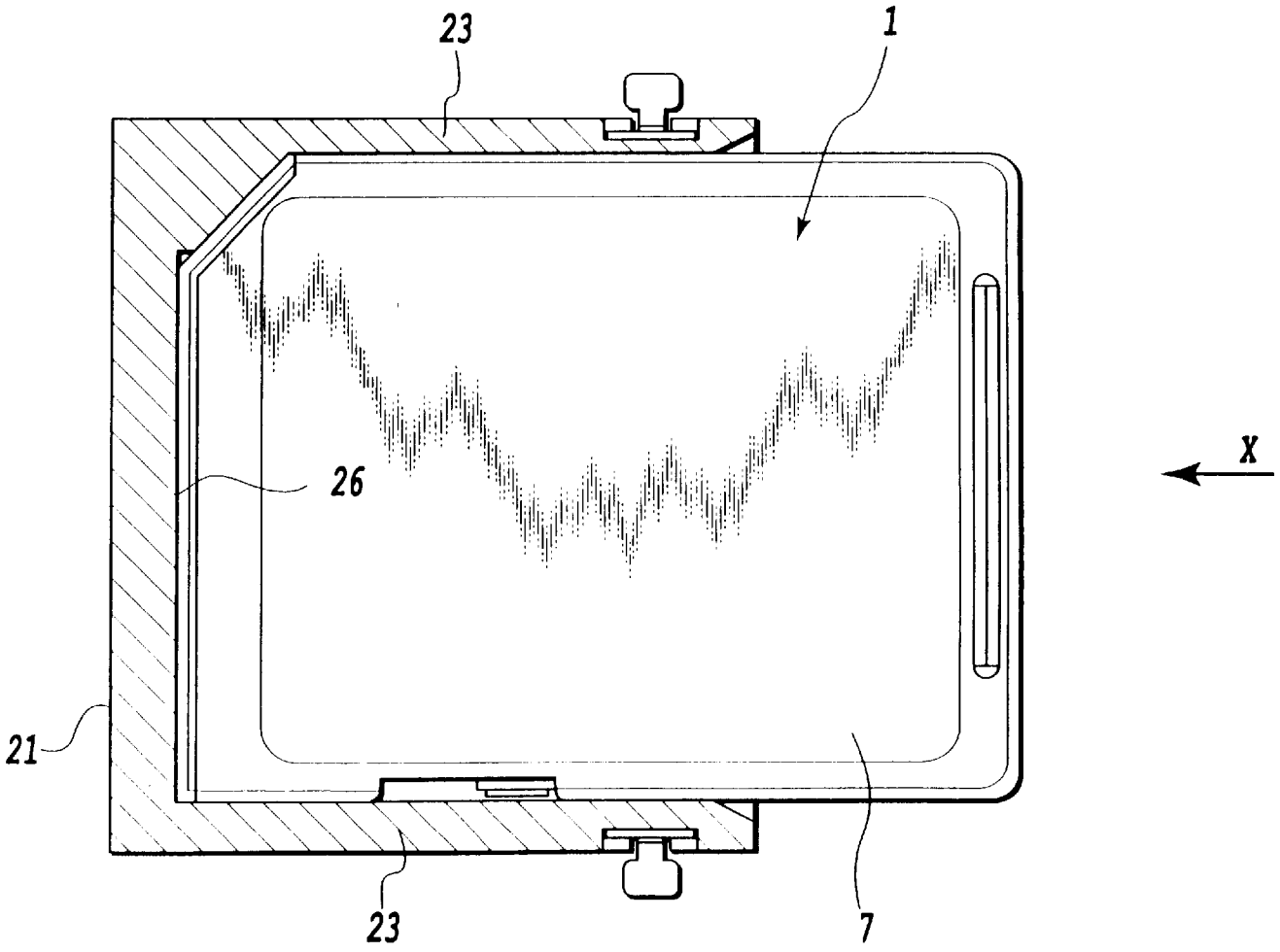
FIG. 6 is a horizontal cross section showing the IC card of FIG. 4 inserted in a card connected state.

In the card connector constructed as described above, when the IC card 1 is held in a correct orientation (see FIG. 4) and inserted into the card connector with the back surface 4 of the IC card 1 supported on the bottom portion 24 of the connector body 21, as shown in FIG. 5, the IC card 1 is guided by the side restriction portions 25*a* without floating up until its front end portion engages the press portion 28*a* of the leaf spring 28. When a further forward push is applied to the IC card 1, the IC card 1 is advanced to press the press portion 28*a*, deflecting the leaf spring 28 into the accommodation groove 24*c*. Then the front end portion of the IC card 1 engages the abutment portion 26, which prevents the further insertion of the card (see FIGS. 5 and 6). At this time, the IC card 1 is in the connected position where a contact pad 3 contacts the electric contacts 22 of the connector 20 with an appropriate pressure.

When on the other hand the IC card 1 is held in an improper state and inserted into the card connector with the front surface 7 of the IC card 1 supported on the support surfaces 24*a* of the connector body 21 as shown in FIG. 7, the IC card 1 advances with the outer side surfaces guided by the side portions 23 and with the recessed surface portions 4*b* of the back surface 4 guided by the side restriction portions 25*a*. The front surface 7 engages and deflects the press portion 28*a* of the leaf spring 28 down as it moves forward (see FIG. 9). After reaching the press portion 28*a*, the IC card 1 receives the upward urging force from the leaf spring, so that the recessed surface portions 4*b* are pressed against the side restriction portions 25*a*.

Figure 8:
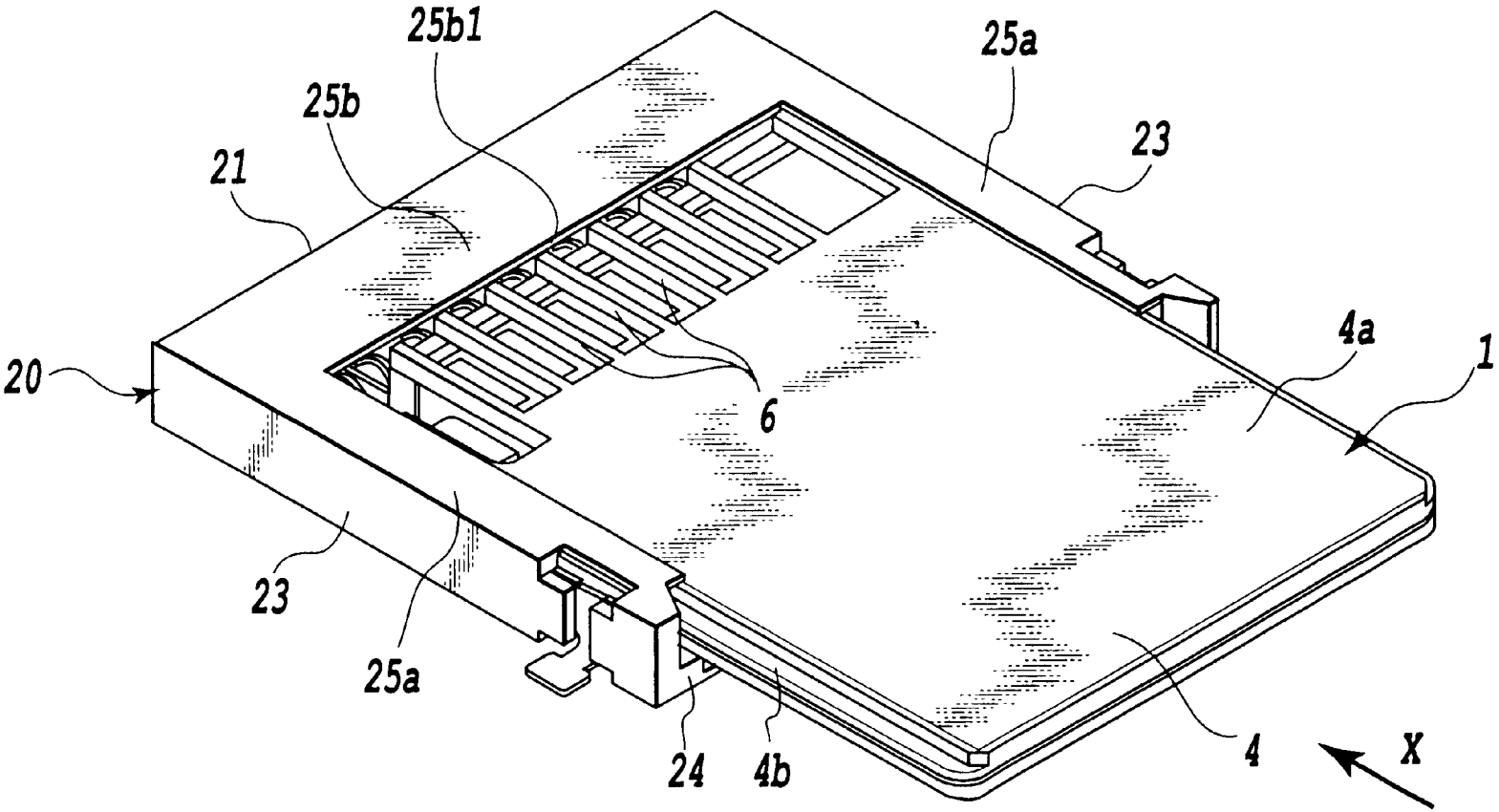
FIG. 8 is a perspective view showing the IC card inserted from the state of FIG. 7 to a position where the IC card abuts against the rear end of the front restriction portion of the card connector.
Figure 9:
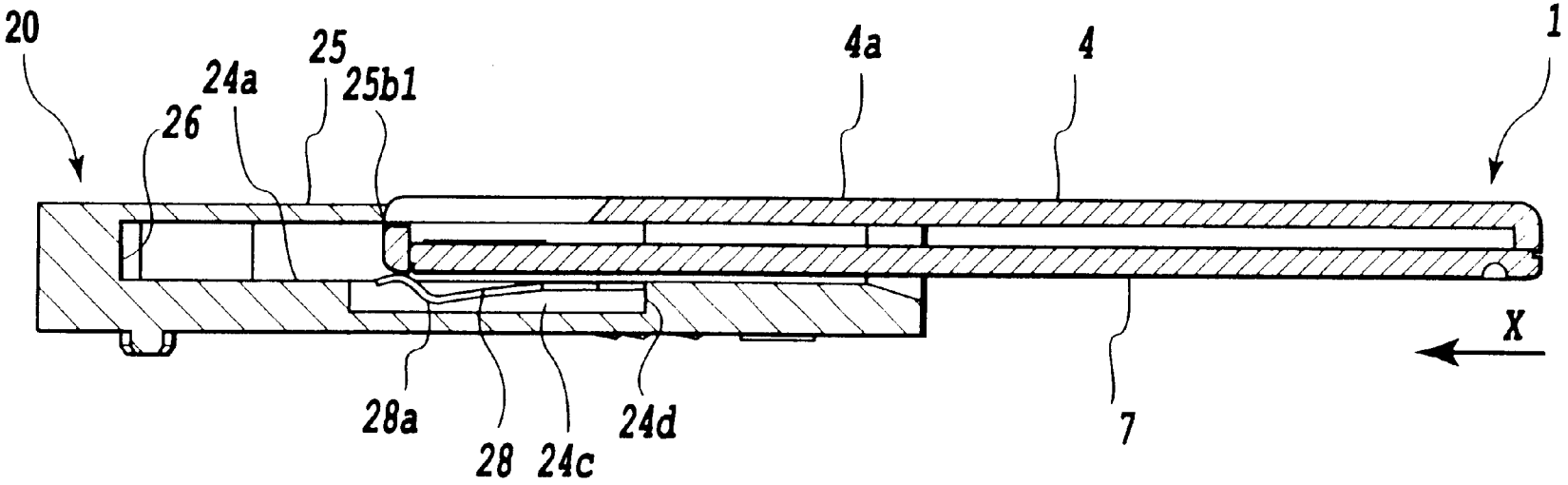
FIG. 9 is a vertical cross-sectional side view showing the IC card of FIG. 8 inserted in the connector

Then, the front end portion of the IC card 1 abuts against the rear end portion (blocking portion) 25*b*1 of the front restriction portion 25*b* which projects rearwardly from the abutment portion 26 (see FIG. 8). At this time, because the recessed surface portions 4*b* are pressed against the underside of the top plate portion 25, the raised surface portion 4*a* projecting above the recessed surface portions 4*b* cannot slide under the top plate portion 25 but abuts against the rear end portion (blocking portion) 25*b*1 without failure, thus blocking the further forward insertion of the card. Therefore, the IC card 1 is clearly identified as being projected at a position behind the connected position with respect to the insertion direction. This enables the user to recognize that the IC card 1 is wrongly inserted, thus protecting the connector body 21 and the IC card 1 against being damaged as by further forced insertion.

Second Embodiment

Figure 10:
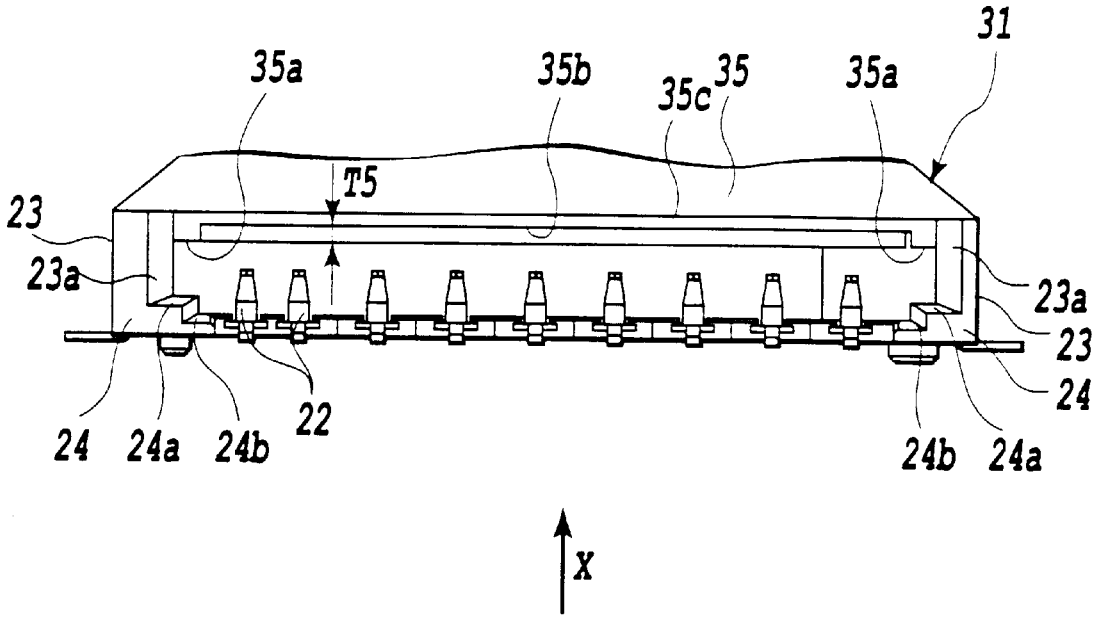
FIG. 10 is a partly cutaway perspective view of a card connector according to a second embodiment of the invention as viewed from the front side.
Figure 11:
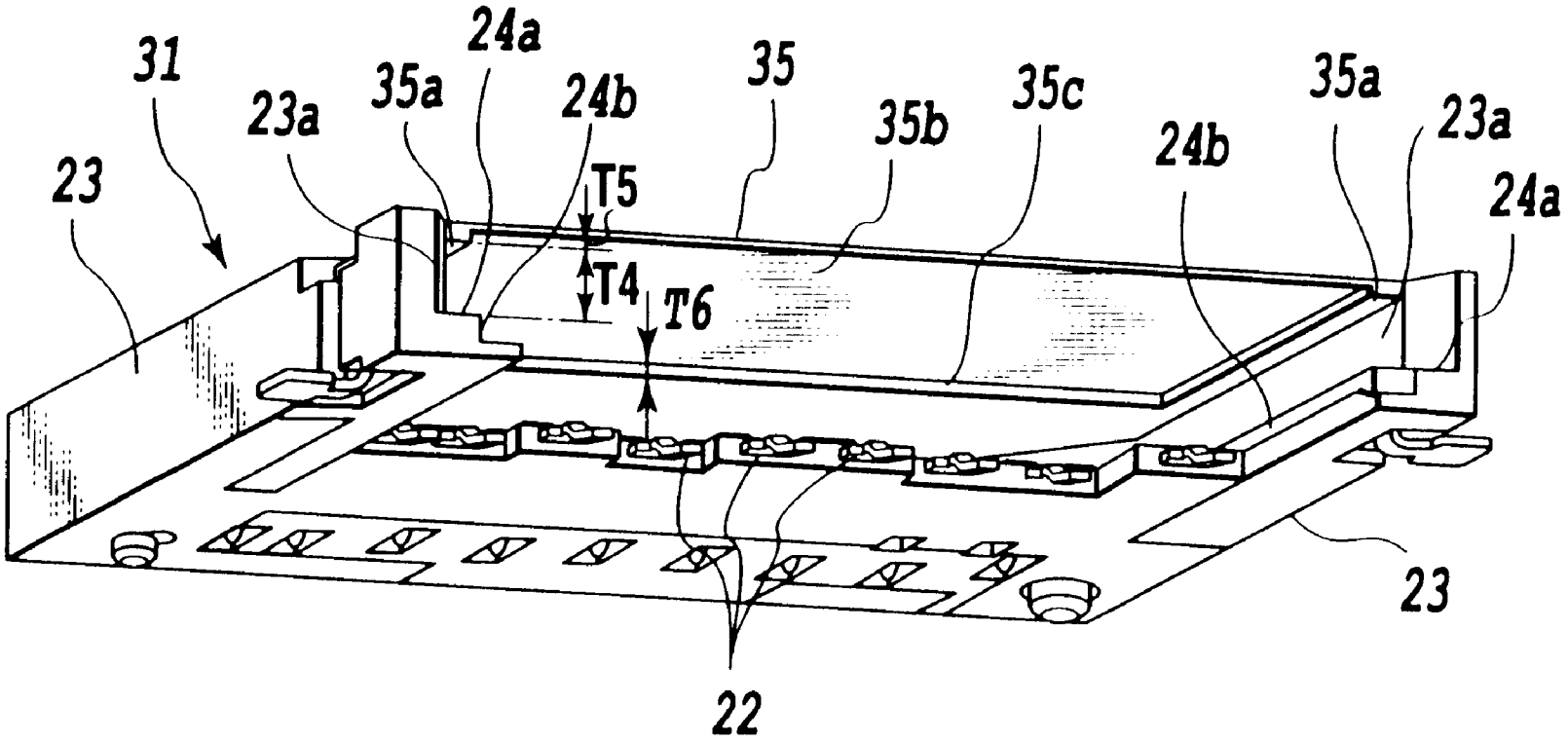
FIG. 11 is a perspective view of the card connector of FIG. 10 as viewed from the bottom side.
Figure 12:
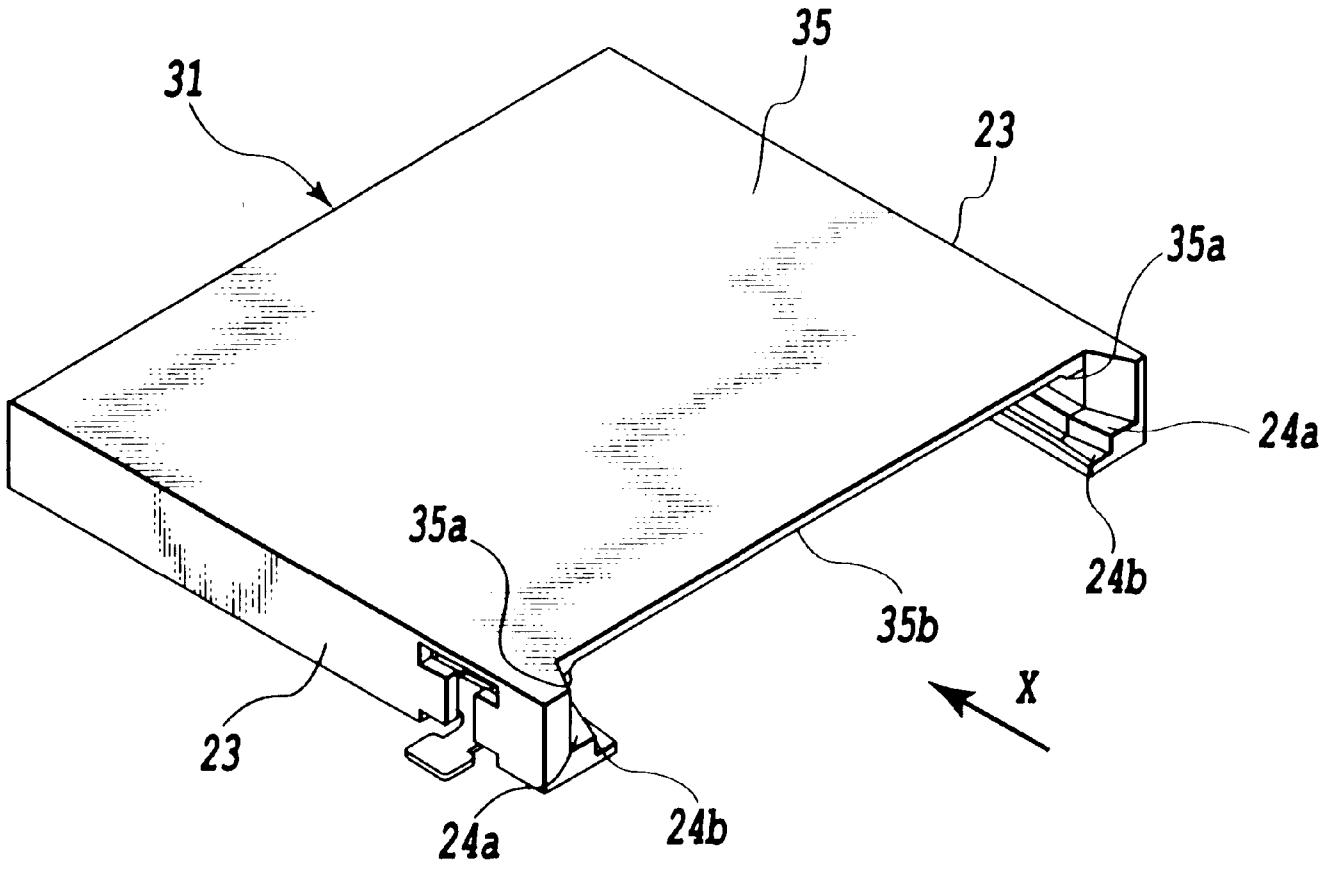
FIG. 12 is a perspective view of the card connector of FIG. 11 as viewed from the top side.

Next, the second embodiment of this invention will be explained by referring to FIGS. 10 to 12. Elements identical with or corresponding to those of the first embodiment are given like reference numerals, and their explanations are omitted.

In the first embodiment, the top plate portion 25 that prevents the IC card 1 from floating upward when it is inserted in the correct state has been described to be shaped like a letter U when viewed from above. A connector body 31 of a card connector 30 according to the second embodiment has a top plate portion 35 that is rectangular when viewed from above and which covers almost entirely the inserted portion of the IC card 1.

The underside of the top plate portion 35 is formed with restriction surfaces 35*a* extending longitudinally along both sides, with a recessed surface portion 35*b* recessed upwardly from the restriction surfaces 35*a* to function as an engagement groove, and with a lock surface (blocking portion) 35*c* protruding toward the bottom side. The restriction surfaces 35*a* face the support surfaces 24*a* of the bottom portion 24 of their distance T4 is set slightly larger than a distance t2 between the recessed surface portions 4*b* and the front surface 7 of the IC card 1. A distance T5 between the recessed surface portion 35*b* and the restriction surfaces 35*a* is set slightly larger than a distance t3 between the raised surface portion 4*a* and the recessed surface portions 4*b* of the IC card 1. Further, the amount T6 by which the lock surface 35*c* protrudes toward the bottom side is set equal to t3.

Other structural aspects are similar to those of the first embodiment.

In the second embodiment constructed as described above, even when the IC card 1 is inserted in a wrong state, e.g., upside down, the recessed surface portions 4*b* of the IC card 1 face the restriction surfaces 35*a* with a minute gap therebetween and the raises surface portion 4*a* bulged upwardly faces the recessed surface portion 35*b* with a minute gap therebetween Hence, until it contacts the press portion 28*a* of the leaf spring 28, the IC card 1 is inserted easily into the connector body 31. When it engages the press portion 28*a*, the IC card 1 is pushed up to press the recessed surface portions 4*b* of the IC card 1 against the restriction surfaces 35*a* of the top plate portion 35. As a result, the raised surface portion 4*a* engages the lock surface 35*c* without failure. Even when the IC card is pushed in with a strong force, the raised surface portion 4*a* is not inserted under the lock surface 35*c* but is reliably blocked by it. This lock position is well short of the connected position (where the abutment portion 26 and the front end portion of the IC card 1 engage) and therefore the user can easily identify the wrongly inserted state.

When the IC card 1 is inserted in an appropriate state, the restriction surfaces 35*a* prevent the IC card 1 from floating upward, guiding the IC card 1 smoothly and properly to the connected position. Further, in the second embodiment, because the top plate portion 35 is rectangular in shape, it serves as a reinforcement member to increase the rigidity of the connector 20 as a whole and also helps protect the IC card and prevents ingress of dust.

Third Embodiment

Figure 13:
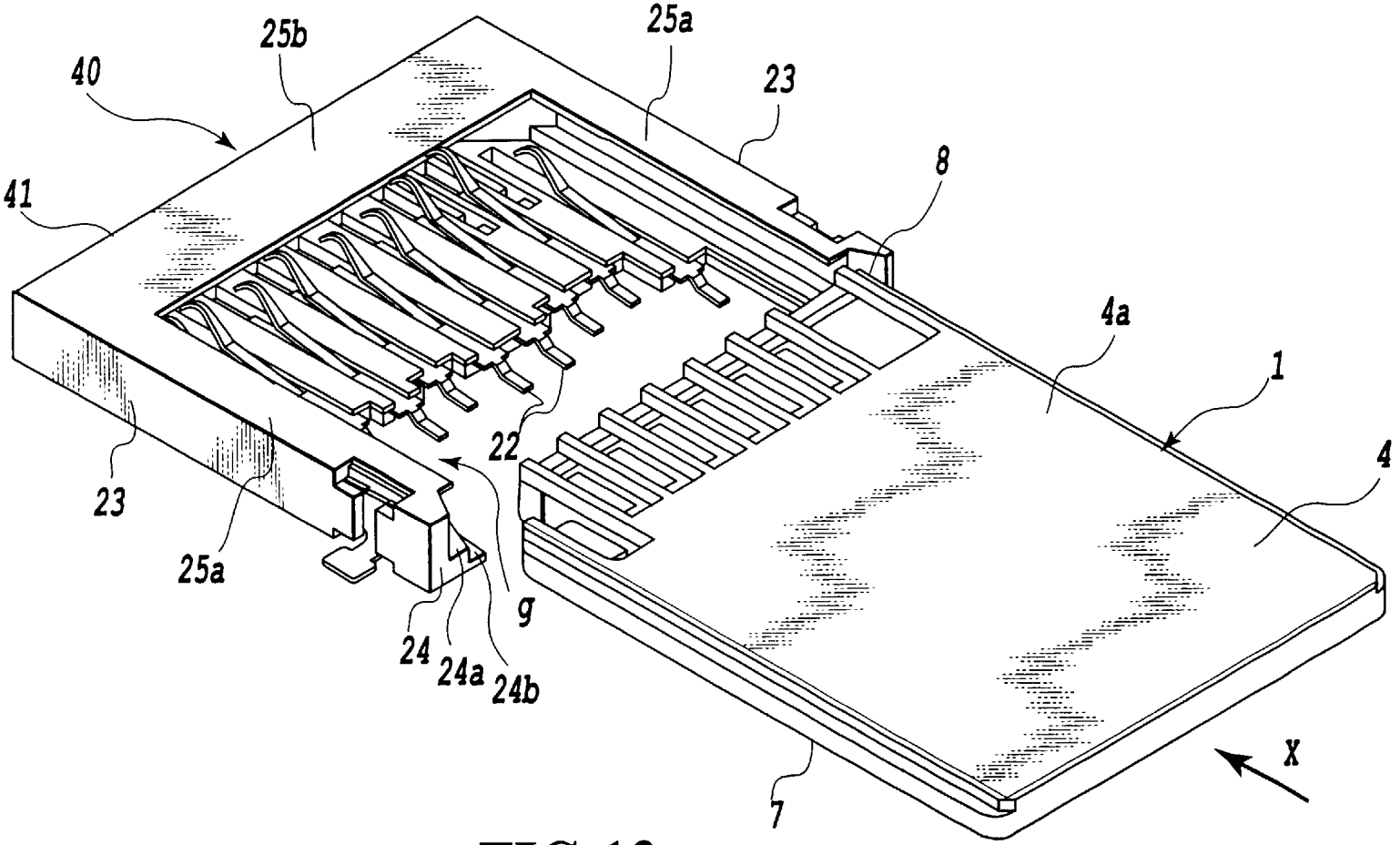
FIG. 13 is a perspective view of a card connector
Figure 14:
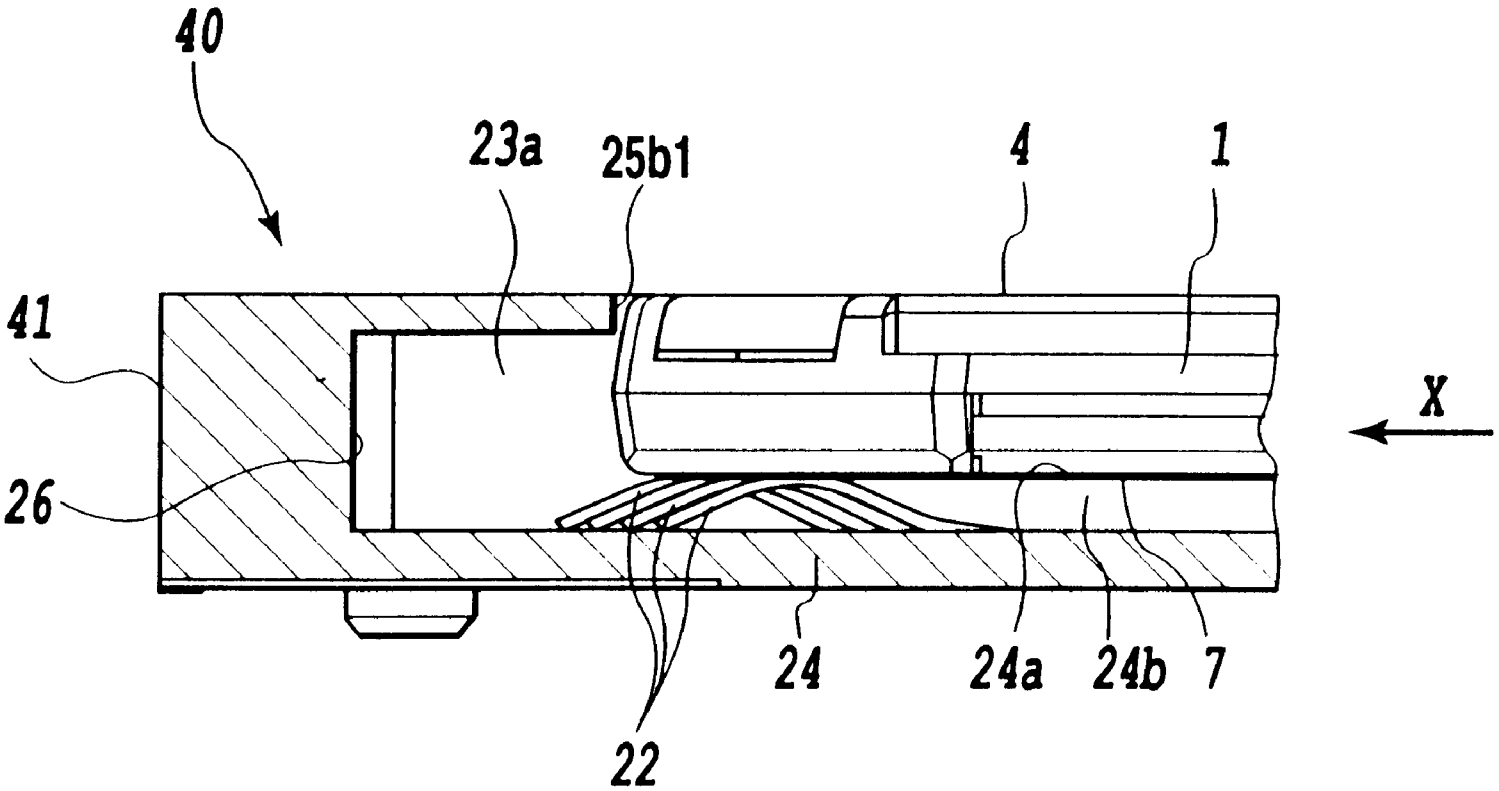
FIG. 14 is a vertical cross-sectional side view showing the IC card inserted from the state of FIG. 13 to a position where the IC card abuts against the rear end portion of the front restriction portion of the connector.

While in the preceding embodiments we have described example cases where the leaf spring 28 as a means for urging the inserted IC card 1 upward is added to the support surfaces 24*a* of the connector body 21, it is possible to use other elastic members than the leaf spring as the urging means. As in the third embodiment shown in FIGS. 13 and 14, it is also possible to use as the urging means electric contacts 22 that are originally intended to make electrical contact with the contacts 3 of the IC card 1. In FIGS. 13 and 14, elements that are identical with or corresponding to those in the first embodiment are given like reference numerals.

A card connector 40 according to the third embodiment urges the IC card 1 to press against the side restriction portions of the top plate portion by the elastic force of the electric contacts 22 in the connector body 41. The position of the rear end portion 25*b*1 of the front restriction portion 25*b* is set in front of the contact engagement position between the IC card 1 and the electric contacts 22 with respect to the IC card insertion direction.

In the third embodiment, before it reaches the front restriction portion 25*b*, the IC card 1 is urged upward by the force of the electric contacts 22 to press the IC card 1 against the top plate portion 25. Hence, when the IC card 1 is inserted upside down, the raised surface portion 4*a* can be reliably made to engage the rear end portion 25*b*1 of the front restriction portion 25*b*, thus blocking the IC card 1 before the connected position without fail.

As described above, with the card connector of this invention, when the IC card is inserted wrongly, it is blocked before the connected position to prevent from being inserted further. Hence, the user can easily recognize that the IC card was wrongly inserted. This prevents a forced insertion of the IC card and therefore prevents possible damages to the connector body and IC card.

The present invention has been described in detail with respect to preferred embodiments, and it will now be apparent from the foregoing to those skilled in the art that changes and modifications may be made without departing from the invention in its broader aspect, and it is the intention, therefore, in the appended claims to cover all such changes and modifications as fall within the true spirit of the invention.

What is claimed is:

1. A card connector having a connector body for removably holding an inserted IC card with a raised surface portion on a back surface side and electric contacts for making electrical contact with the IC card inserted in the connector body, the connector body comprising:

side portions having card side surface guiding surfaces to guide side surfaces of the inserted IC card;

a bottom portion having a support surface to support a front surface or back surface of the inserted IC card and stepped portions to engage the raised surface portion formed on the back surface so that the raised surface portion can be moved in an IC card insertion/retraction direction when the back surface of the IC card is supported on the support surface;

a top plate portion disposed opposite the bottom portion to prevent the inserted IC card from floating upward; and an urging means provided in the connector body to urge the IC card upward at a predetermined position with respect to the card insertion direction;

wherein the top plate portion having:

an under guiding surface disposed to guide the front or the back surface; and a blocking portion to, when the front surface of the IC card is supported on the support surface, engage the raised surface portion of the IC card at a predetermined blocking position to prevent an incorrectly oriented IC card from being moved forward from the blocking position and prevents the IC card from sliding under the top plate, the blocking portion being disposed in front, with respect to the IC card insertion direction, of the predetermined position where the IC card is urged by the urging means.

2. A card connector according to claim 1, wherein the blocking portion is an end face of the top plate.

3. A card connector according to claim 1, wherein the top plate has the front surface side guiding surface rectangular in shape and formed in an under surface side thereof and a recessed surface portion recessed upward into the front surface side guiding surface, and wherein the blocking portion is formed by a blocking surface that protrudes from the recessed surface portion toward the bottom portion side and extends perpendicular to the IC card insertion direction.

4. A card connector according to claim 1, wherein the urging means is formed by an elastic member formed on the support surface and protruding upward from the support surface.

5. A card connector according to claim 4, wherein the elastic member is a spring provided on and protruding from the support surface.

6. A card connector according to claim 4, wherein the elastic member is the electric contacts having elasticity and held by the bottom portion to protrude upward.

7. A card connector according to claim 2, wherein the urging means is formed by an elastic member formed on the support surface and protruding upward from the support surface.

8. A card connector according to claim 3, wherein the urging means is formed by an elastic member formed on the support surface and protruding upward from the support surface.

* * * * *

UNITED STATES PATENT AND TRADEMARK OFFICE

CERTIFICATE OF CORRECTION

PATENT NO. : 6,607,404 B1
DATED : August 19, 2003
INVENTOR(S) : Toshiyasu Ito et al.

It is certified that error appears in the above-identified patent and that said Letters Patent is hereby corrected as shown below:

Title page,
Item [57], ABSTRACT,
Lines 6-7, "card , insertion/retraction" should read -- card insertion/retraction --.
Item [74], *Attorney, Agent or Firm*, "Finneganm" should read -- Finnegan, --.

Signed and Sealed this

Thirteenth Day of April, 2004

JON W. DUDAS
*Acting Director of the United States Patent and Trademark Office*